United States Patent [19]

Swanson

[11] 4,186,844

[45] Feb. 5, 1980

[54] EASY OPENING TRASH BIN LID

[76] Inventor: Raymond Swanson, 5090 N. 109th, Longmont, Colo. 80501

[21] Appl. No.: 7,662

[22] Filed: Jan. 29, 1979

[51] Int. Cl.[2] ..... B65D 43/14; B65D 51/04

[52] U.S. Cl. ..... 220/333; 220/1 T

[58] Field of Search ..... 220/1 T, 331, 333, 334

[56] References Cited

U.S. PATENT DOCUMENTS

| | | | |
|---|---|---|---|
| 4,014,457 | 3/1977 | Hodge | 220/331 |
| 4,098,429 | 7/1978 | Hodge | 220/334 X |

*Primary Examiner*—George T. Hall

*Attorney, Agent, or Firm*—Richard D. Law

[57] ABSTRACT

A generally planar lid for rectangular trash bins, having a shortened rear wall and chamfered rear corners of the side walls, a leaf at each side of lid adjacent the rear wall, a leaf hinge point on the front of each leaf pivotally connected to the sides of the bin and spaced below the top edge of the side walls, a lid hinge on rear edge of the lid pivotally secured to a hinge point on the upper rear of the leaves, and a stop on a lower rear point of the leaves for impinging on the rear wall of the bin to limit pivotal movement of the plate.

9 Claims, 5 Drawing Figures

EASY OPENING TRASH BIN LID

This application relates to lids for trash containers of the relative large rectangular type, and particularly to easy opening lids for such containers.

The large trash containers used by commerical establishments, including multiple housing units, are arranged to dump by a machine, usually a trash collection truck with container handling means. This usually involves mechanically lifting and inverting the trash container to dump into the waste receptacle on the truck. The trash containers in most areas of the country must have attached lids. Obviously, the lids must be raisable by people depositing trash into the container, and they should be easily raised, staying partially open for depositing trash. The lids are formed of sheet metal and are heavy, and particularly when hinged at their rear edges are difficult to open. Several hinges have been proposed which reduces the force necessary to open the lids, but these involve rollers and moving hinges and, therefore, are complicated, easily disrupted in operation and not entirely satisfactory.

THE PRESENT INVENTION

The present invention provides a double hinge arrangement using a pair of pivotal plates pivotally hinged to opposed side walls of a trash container, and a lid hinge pivoting said lid in relation to plates and laterally spaced from the plate pivots, along with a stop to limit plate rotation in either direction. The rear wall is formed at a lower level than the front wall, with a short diagonal stretch of the side walls adjacent the rear walls. The arrangement provides a partial opening of the lid by pivoting the plates on side wall hinges. These plate hinges are placed forward of the rear edge of the lid, reducing lift force necessary to partially open the lid. On inverting the trash container, the lid pivots fully open on the hinges between the plates and rear edge of the lid.

OBJECTS OF THE INVENTION

Included among the objects and advantages of the invention is to provide an easy opening lid for large rectangular trash containers.

Another object of the invention is to provide a arrangement for holding a trash container lid partially open.

Yet another object of the invention is to provide a double pivoting hinge arrangement for large trash containers, permitting the lid to be easily partially opened and permitting it to stay partially open, and opens fully on being inverted.

Still another object of the invention is provided a trash container lid with a double hinging arrangement effectively reducing the force necessary to raise the lid.

Additional object of the invention is to provide a modification to rectangular trash containers for the application of a double hinge arrangement for the lids of the trash containers.

These and other objects and advantages of the invention may be readily ascertained by reference to the following description and appended illustrations.

GENERAL DESCRIPTION OF THE DRAWINGS

SPECIFIC DESCRIPTION OF THE DRAWINGS

Figure 1:
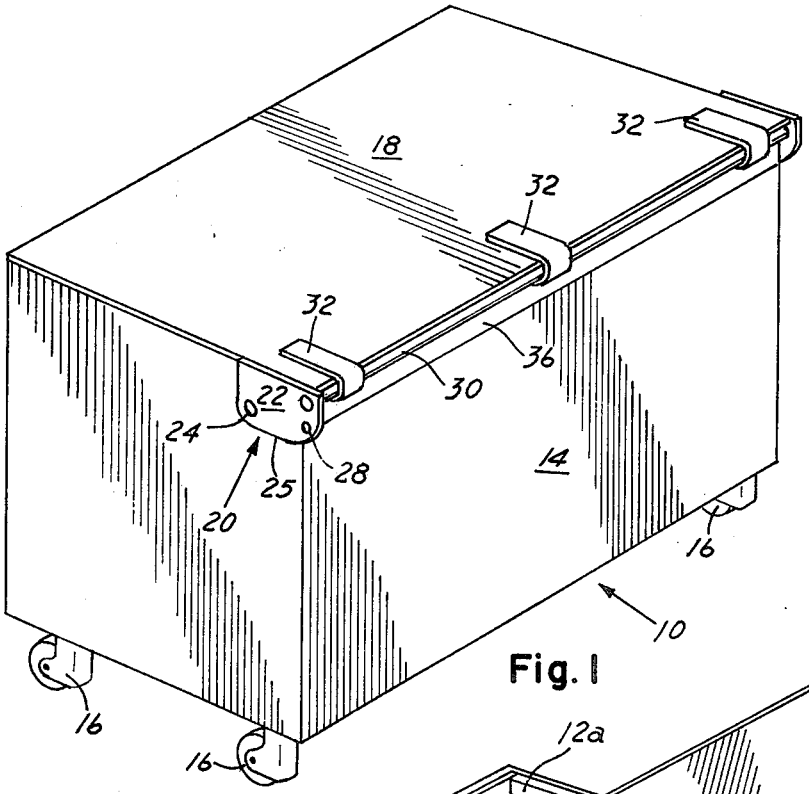
FIG. 1 is a perspective view of a trash container with a hinged lid, according to the invention, in closed position.

In the embodiment shown in the drawings, a rectangular trash container, shown generally by numeral 10, conventially includes side walls and a bottom, with an open top. End walls 13, the front wall 15 and the rear wall 14 may be formed by breaking a single sheet of metal at right angles or individual wall members may be welded together. A bottom, not shown, is secured to the sides, front and rear walls in a liquid tight relation. Conventionally such trash containers include casters or other rollers for mobility as for example, casters 16 shown, and, of course, casters or wheels (not shown) at the other end. A planar lid 18 is mounted for closing the open top of the container, being mounted by means of a hinge assembly, shown generally by numeral 20.

The container assembly may include a steel bar welded or otherwise secured to top of the side walls to provide a seating surface for the lid, and for the installation of soft gaskets. One form of gasket currently being used is a soft foamed rubber rod; another form is a hollow, tubular rubber strip etc. Side walls 14 include bars 12*a* welded or otherwise secured to top inside edges of the walls, and a bar 19 welded to front top of the wall 18, form with top edges of the walls a generally planar lid seating surface. The two side walls are cut off at an angle (ranging from about 25° to 60° and preferably 45°) adjacent the rear wall 14 at 13, so that the top of the rear wall is below the plane of the top of the other walls.

The hinge mechanism (only one side is described but obviously there is a mirror image hinge on the other side of the lid), provides a double pivot point for each side of the lid. The hinge assembly includes a hinge plate 22 which is mounted on pivot pin 24 secured in the adjacent side wall forward of the rear wall 14. This plate, with the lid closed, is sufficiently large to cover the opening left by the cut-off side wall section. The plate 22 includes a straight edge 23 which is generally parallel with the top of the container when the lid is closed. The plate, also, includes an arcuate edge 25 which extends from edge 23 to front edge 26. The edges 23 and 26 are generally at a right angle. A stop is secured to the plate to limit pivotal movement of the plate around the pivot pin 24. A stop rod or bar 28 is secured in each plate 22 adjacent the edge 25 and spaced from edge 23. This bar limits clockwise pivoting of the plate by the stop bar impinging on the rear wall 14 below the top of the rear wall, and counterclockwise pivoting by impinging adjacent the top of the rear wall 14. The bar 28 therefore, permits limited pivoting of the plate in the range of 30°–60° and preferably about 45°. The lid 18 is secured to a rod 30 by means of eyed straps 32, in which the eyes are large enough to turn on the rod. The hinge includes a strap portion welded to the top. This permits the lid to pivot on the bar 30. A cover plate 36 extends downwardly from the rear edge of the lid to the stop bar 28 thereby closing the opening between the lid and the top of the rear wall, when the lid is closed. The cover plate 36 is independant of bar 30.

The container is normally made of relatively heavy guage steel plate so as to be servicable for the handling to which the container is subjected. The lid is, also, of heavy guage steel, which if mounted by rear edge hinges would make the heavy lid difficult to open, particularly where a person uses one hand to push upwardly to open and then hold the lid while the other hand dumps a small container into the larger container.

Figure 2:
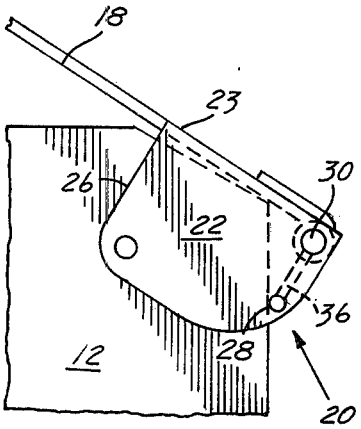
FIG. 2 is an enlarged detail, side elevational view of a hinge, according to the invention, with an attached lid partially open.
Figure 3:
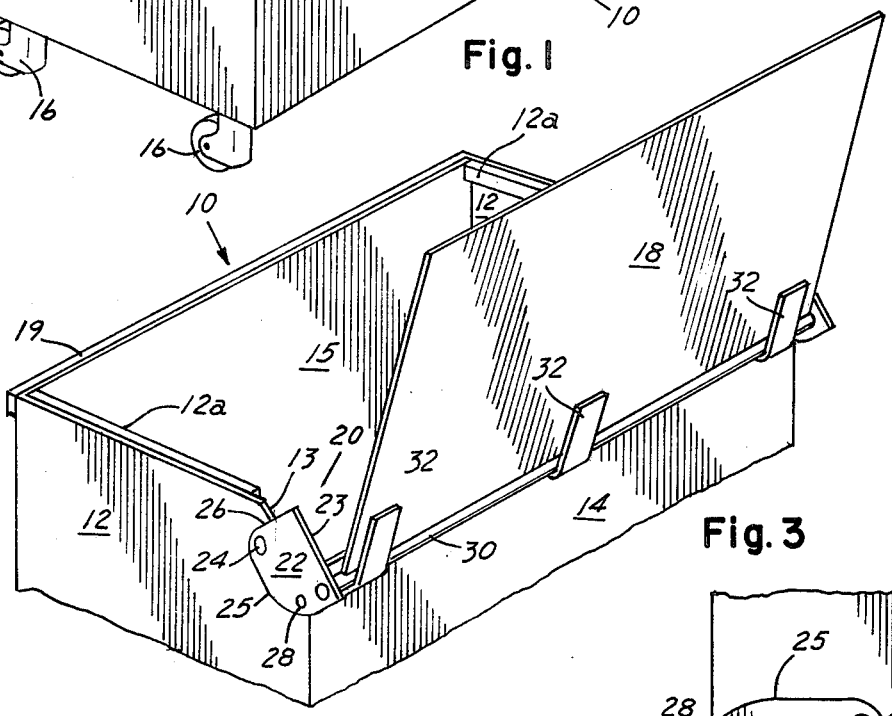
FIG. 3 is a perspective view, of the upper part, of a trash container with its lid fully open.
Figure 5:
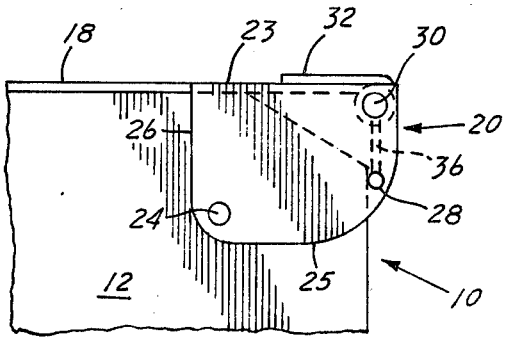
FIG. 5 is an enlarged detail, side elevational view of a portion of a trash container with the lid fully closed.

The operation of the device is a two mode opening of the lid. When the lid is closed, FIG. 5, it lies flush on the top edges of side walls and front wall which are in a plane, or the lid lies on the gaskets on the wall. The plates 22 (therebeing one on each side) cover the cut out portions of side walls, and the plate 36 covers the opening between the lid and rear wall top. The stop bar 28 prevents further counterclockwise rotation of the plate 22 when it impings on the top of the rear wall, thereby, also, preventing any forward movement of the lid. For depositing trash into the container, a user pushes up on the front edge of the lid which causes the plates 22 to pivot clockwise on pivot pins 24 until the stop bar 28 impinges on the rear wall of the container, FIG. 2, which is a position below the top of the rear wall. Since the pivot 24 is forward of the rear edge of the lid and acts as the pivot point for this initial opening, the lid is in effect counterbalanced (by the weight of the lid rearwardly of a perpendicular through the pin 24) reducing the force necessary to open the lid. By correctly positioning the pin, the lid will be balanced in its partially open position and will remain open until pulled downwardly to close. This provides an easily opened lid either from the exterior or the interior (in the event a child or other has entered the trash container). The container lid may be more fully opened by further pushing lid, from the partially open condition of FIG. 2, so that the lid pivots on the bar 30. The lid may swing around to where it lies against the rear wall 14.

Figure 4:
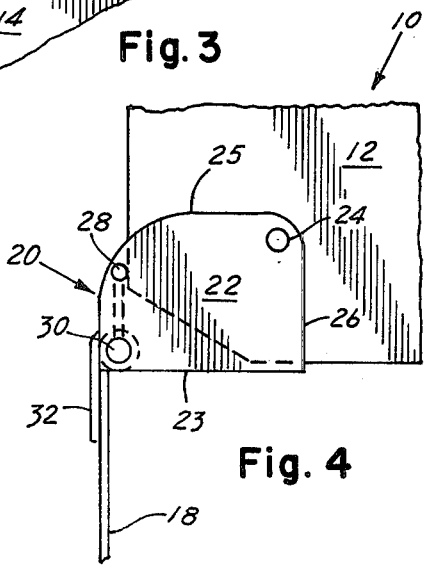
FIG. 4 is a side elevational view, of a portion of a trash container in inverted, dumping position with its lid fully open.

For dumping, the container is lifted by the pickup arms on trash truck, and is turned upside down, FIG. 4. This permits the lid to open fully and empty the container of its content. In the inverted position the lid pivots or swings by the hinges 32 on bar 30 to its downwardly hanging position, permitting the container to have the full open top.

The hinge of the invention not only provides an easy opening lid, but is a safety lid to prevent persons from being injured by a falling lid on a user's hand or arm or being trapped in the container. The hinge is rugged and capable of substantial abuse without disrupting its operation.

What is claimed is:

1. A hinged lid rectangular trash container comprising:

(a) a container having two side walls, front and rear walls, and a bottom, providing a full open top and planar lid means therefore, (b) said side walls having opposed cut-off corners adjacent said rear wall, (c) said rear wall being smaller in height than said front wall and joining at said cut-off of said side walls, (d) hinge means on each side of said container including plate means mounted on pivot means pivotally connected to each said side wall at a point forward of said rear wall, and each said plate arranged to pivot about said povot means, (e) stop means associated with each said plate means limiting clockwise and counterclockwise pivotal movement of each said plate means, and (f) lid hinge means including plate connecting means and pivotal connecting means at the rear edge of said lid means to said plate connecting means, providing pivoting movement of said lid means, independant of said plate means.

2. A hinged lid rectangular trash container according to claim 1 wherein each said side plate means covers said cut-off side wall corners in lid-closed position.

3. A hinged lid rectangular trash container according to claim 1 wherein rear plate means secured to the rear edge of said lid covers the opening between said lid means and the top of said rear wall in closed position.

4. A hinged lid rectangular trash container according to claim 1 wherein said stop means is a bar extending from one said plate means to the other said plate means and arranged to impinge on said rear wall adjacent the top edge thereof limiting counterclock rotation of said lid means, and impinging on said rear wall at a position lower below the top edge to limit clockwise rotation of said plate means.

5. A hinged lid rectangular trash container according to claim 1 wherein said plate connecting means includes a rod secured to each said hinge plate means, and hinge portions secured to said lid means and pivotal on said rod.

6. A hinged lid rectangular trash container according to claim 5 wherein said hing portions includes a plurality of eyes pivotally mounted on said rod and a strap portion extending from each eye is secured to the rear edge of said lid means.

7. A hinged lid rectangular trash container according to claim 6 wherein said strap portions are relatively narrow and a plurality of such are generally uniformly spaced and secured to the rear edge of said lid means.

8. A hinged lid rectangular trash container according to claim 1 wherein said pivot means for said plate means are positioned sufficiently forward of said rear wall to permit said planar lid means to remain open at a 30°–60° angle to the plane of the top of said container front and side walls.

9. A hinged lid rectangular trash container according to claim 8, wherein said pivot means for said plate means are positioned so as the permit said planar lid to partially open at about a 45° to the plane of the top of said container front and side walls.

* * * * *